US008157138B2

(12) United States Patent
Leyendecker

(10) Patent No.: US 8,157,138 B2
(45) Date of Patent: Apr. 17, 2012

(54) CARRYING SYSTEM FOR RUCKSACKS

(75) Inventor: Daniel Leyendecker, Andechs (DE)

(73) Assignee: Tatonka GmbH Qualitätsausrüstung für Freizeitaktive (DE)

( * ) Notice: Subject to any disclaimer, the term of this patent is extended or adjusted under 35 U.S.C. 154(b) by 816 days.

(21) Appl. No.: 12/279,441

(22) PCT Filed: Feb. 16, 2007

(86) PCT No.: PCT/EP2007/051536

§ 371 (c)(1),
(2), (4) Date: Oct. 16, 2008

(87) PCT Pub. No.: WO2007/093644

PCT Pub. Date: Aug. 23, 2007

(65) Prior Publication Data

US 2009/0026241 A1 Jan. 29, 2009

(30) Foreign Application Priority Data

Feb. 16, 2006 (DE) ..... 10 2006 007 334

(51) Int. Cl.
*A45F 3/04* (2006.01)

(52) U.S. Cl. ..... 224/637; 224/627; 224/628; 224/631; 224/638; 224/639; 224/640; 224/641; 224/650; 224/651; 224/259; 224/153

(58) Field of Classification Search ..... 224/627–659, 224/575, 576, 259, 153; 128/205.22; 405/185; 182/3

See application file for complete search history.

(56) References Cited

U.S. PATENT DOCUMENTS

| | | | | | |
|---|---|---|---|---|---|
| 4,033,488 | A * | 7/1977 | Brewer | 224/259 |
| 4,168,022 | A * | 9/1979 | Brewer | 224/257 |
| 4,318,502 | A * | 3/1982 | Lowe et al. | 224/153 |
| 4,402,440 | A * | 9/1983 | Purtzer et al. | 224/160 |
| 5,341,973 | A * | 8/1994 | Dawes et al. | 224/196 |
| 5,427,290 | A | 6/1995 | Thatcher | |
| 5,806,741 | A * | 9/1998 | Kirk | 224/634 |
| 5,954,250 | A | 9/1999 | Hall et al. | |
| 6,010,051 | A * | 1/2000 | Callanan | 224/651 |
| 6,079,602 | A * | 6/2000 | Howell | 224/637 |
| 6,164,505 | A * | 12/2000 | Holter et al. | 224/259 |
| 6,321,959 | B1 * | 11/2001 | Howell | 224/262 |
| 7,152,771 | B2 * | 12/2006 | Le Gal et al. | 224/631 |
| 7,828,180 | B2 * | 11/2010 | Slesar | 224/257 |
| 2002/0108982 | A1 | 8/2002 | Mydans | |
| 2004/0238584 | A1 * | 12/2004 | Herold | 224/610 |
| 2007/0057002 | A1 * | 3/2007 | Timm et al. | 224/625 |
| 2009/0173763 | A1 * | 7/2009 | Bridgeman | 224/674 |
| 2009/0242598 | A1 * | 10/2009 | Dormaar | 224/257 |
| 2010/0206921 | A1 * | 8/2010 | Shen | 224/150 |
| 2011/0278339 | A1 * | 11/2011 | Hexels | 224/676 |

* cited by examiner

*Primary Examiner* — Thanh Truong
*Assistant Examiner* — Gloria R Weeks
(74) *Attorney, Agent, or Firm* — Brooks Kushman P.C.

(57) ABSTRACT

The invention relates to a carrying system for a rucksack with at least one accommodation container with at least two shoulder straps which connect the rucksack to a carrier, with each shoulder strap having at least two strap sections, and with each shoulder strap having at least one first releasable connecting device which connects the two strap sections to one another. The carrying system according to the invention is characterized in that a triggering device is provided which can be operated by the carrier and is connected to at least two releasable connecting devices in such a way that the connecting devices are released substantially without a time delay when the triggering device is operated.

16 Claims, 4 Drawing Sheets

CARRYING SYSTEM FOR RUCKSACKS

TECHNICAL FIELD

The present invention relates to a carrying system for rucksacks, in particular to a connecting system for carrier straps of a rucksack and a method for separating the carrier straps of such a rucksack from its carrier.

BACKGROUND

Carrying systems for rucksacks are known in the art. In addition to two shoulder straps, these carrying systems usually comprise at least one waist strap, and in particular designs also a chest strap, which connect a suitable carrying container to its carrier. In addition to small rucksacks for day-to-day use, elaborate rucksack systems are also increasingly employed which are adapted for various uses, particularly referring to the design of the accommodating container, to suit the carrier's individual requirements. In that context, in addition to light and simple rucksack systems there are also highly elaborate and sometimes large-volume rucksacks or heavy-load rucksacks, which provide compensational carrying comfort, even during long periods of using the rucksack, by means of the carrying system used.

However, what is problematic about these carrying systems known from prior art is that such a rucksack is rather complicated to put on and take off, respectively, because in addition to opening the chest strap and the waist strap, taking off the shoulder straps is relatively cumbersome and/or complicated, especially with rucksacks that are heavy due to their load. However, it is necessary to quickly take off the rucksack particularly in special applications where the carrier is forced by external circumstances to separate the rucksack, in particular a bulky rucksack, from him or herself as quickly as possible, particularly in order to regain full mobility. In particular, such objectives are known where a bulky and heavy rucksack may considerably impair a carrier's movements, and the carrier, particularly in a dangerous situation, has to regain mobility, which may even be life-saving, by quickly putting down the rucksack.

Thus, it is the object of the present invention to provide a rucksack, in particular a carrying system for a rucksack, by which the disadvantages known from prior art are at least partly eliminated.

SUMMARY

According to the invention, the carrying system for a rucksack comprises at least one accommodating container and two shoulder straps connecting the rucksack to a carrier. Each shoulder strap further comprises at least two strap sections. The shoulder straps include at least one releasable connecting device connecting the two strap sections of each shoulder strap to each other. The inventive carrying system for a rucksack is characterized in that there is provided a triggering device, which can be operated by the carrier in particular and is connected to at least two releasable connecting devices in such a way that upon operation of the triggering device the connecting devices are released substantially without time delay.

A strap section according to the present invention is understood to be a section of a strap that is preferably connected, at least at one end, to the rucksack. It is of course within the meaning of the present invention that such a strap, depending on its position during use, may be configured in various ways and may, in particular, be constructed of several components which are preferably arranged on top of each other or one behind another. Thus for example, a shoulder strap comprises on sections thereof a support or padding on the side facing the carrier, with a piece of webbing arranged on its upper side which substantially transfers the forces between the accommodating container and the carrier. It is of course also within the meaning of the present invention to deviate from this embodiment of a strap and to adapt the shape and design to suit the carrier's respective needs. This may also include a device for changing the strap length.

Furthermore, the feature "substantially without time delay" according to the present invention is understood to mean that upon operation of the triggering device, preferably by the carrier, the connecting device is released in an immediate temporal relationship, it being noted that a time delay also includes the situation where the various connecting devices are released in a predetermined chronological order, which is done substantially without any corresponding dead time such as is known from control engineering.

Of course it is also within the meaning of the present invention that all connecting devices are released at the same time, wherein the previously described release of the connecting devices in a predetermined chronological order provides the further advantage that the carrier can to some extent influence the direction of motion of the rucksack as it is being separated, thus further reducing impairment to the carrier.

In another particularly preferred embodiment, the carrying system comprises at least one waist strap comprising at least two strap sections which are connected to each other by at least one second releasable connecting device.

The carrying system for a rucksack in another preferred embodiment further comprises at least one chest strap preferably connecting at least two shoulder straps and also consisting of at least two strap sections. The strap sections themselves are connected to each other by at least one third releasable connecting device.

In a preferred exemplary embodiment, the triggering device is secured against inadvertent operation by a first securing device, so that the triggering device cannot be operated in the secured state. In particular, such a securing device has the advantage of substantially preventing inadvertent operation, such as might occur, for example, if the rucksack hits any objects when being carried in difficult terrain.

Such securing devices may, for example, be covers with a suitable hook-and-loop fastener, which permit access to the securing device only after the corresponding tab has been removed. It is also within the meaning of the present invention to fix the triggering device itself to a component of the rucksack, in particular of the waist strap.

In another particularly preferred embodiment, the carrying system is characterized in that at least one of the first, second and/or third releasable connecting devices is secured, by second securing devices, against inadvertent release. This can be accomplished, for example, by the connecting device being completely or at least partly covered in such a way that here, too, an inadvertent release is to a large extent prevented. Thus, for this purpose, a cover may be used for example which is fastened by a hook-and-loop fastener in the vicinity of the strap section, and either has to be removed before releasing or opening the connecting devices, or is released from the strap when the connecting device itself is released.

Moreover, the securing device for releasing the connecting devices may also be double secured wherein, for operation, first a cover and then the triggering device are released from the carrying system in such a way that by operating the triggering device the connecting devices are released, i.e., separated.

In that context, the triggering devices are coupled to one of the connecting devices, preferably by mechanical, electrical and/or optical connecting means, the connecting device preferably being selected, in a particularly preferred embodiment, from a group including electrical conductors, optical conductors, metallic and non-metallic strings and wires, ropes, Bowden cables, combinations thereof, and the like.

According to the present invention, connecting means are understood to connect, in particular, the at least one triggering device to the connecting device in such a way that upon operation of the triggering device the connecting device is released and the at least two strap sections connected via the connecting device are thus separated.

In another particularly preferred embodiment, the connecting device for the carrying system includes at least two rings, each of the two strap sections being fixedly connected to at least one ring of the connecting system. Further, the outer diameter of the first ring is smaller than the inner diameter of the second ring. In the connected state of the connecting device, the first ring with a part of the strap section attached to it is passed through the second ring and is folded back against the direction of extension of the strap section. Furthermore, the first ring is secured with respect to the folding motion in the direction of extension of the strap section.

A folding motion, according to the present invention, is understood to be an opening and closing motion, respectively, of the first ring, occurring about the connecting section of the ring on the strap. The direction of extension of the strap substantially results from the geometric shape of the strap, said shape being selected in such a way that in particular the width or the thickness of the strap are smaller, or significantly smaller, in comparison with the longitudinal extension.

In another particularly preferred embodiment, in the connecting system having at least two rings, a third ring can be provided, the outer diameter of which is smaller, in particular, than the inner diameter of the first ring. In that context, the third ring is fixedly connected to the same strap section to which the first ring is connected. In the connected state of the connecting device, the third ring with a part of the strap section attached to it is passed through the first ring and folded back against the direction of extension of the strap section. Furthermore, this third ring is also secured against a folding motion in the direction of extension of the strap section.

Furthermore, it is within the meaning of the present invention that a whole series of rings is used and, starting from the ring having the largest diameter, each of the subsequent smaller rings is passed through the larger ring located before it, and is folded back.

In a preferred embodiment, the first or the third ring in particular are secured by a retaining device against a folding motion in the direction of extension of the strap section. This retaining device is preferably formed by a securing tab attached to a strap section and extending, in the connected state of the connecting device, through the first and/or third ring. The securing tab itself preferably extends through at least one ring and then extends at the back of the respective ring. The securing tab is preferably fixed by a securing pin.

In another particularly preferred embodiment, the connecting device can also be configured as a buckle coupling, whose buckles, which are opposite to each other and are partly engaged in the connected state, are connected by means of at least one securing pin. In that context, the securing pin is arranged such that it is passed through the engaged buckles in such a way that in the inserted state the buckles are prevented from being released from each other.

A securing pin according to the present invention is understood to be in particular a section of the connecting means, which section is removed from the securing tab or the buckles, immediately or via a suitable actuator upon operation of the triggering device. In that context, the securing pin is connected to the connecting device, with removal of the securing pin enabling a folding motion of the first and/or third ring and releasing the connection, or allowing the buckles to be released from each other.

In another particularly preferred embodiment, the connecting devices are configured as separating means which causes a destructive separation of the two strap sections if the triggering device is operated. This can be achieved, for example, by the strap sections being connected to a plastic tab which is destroyed upon operation of the triggering device.

In another particularly preferred embodiment, the securing device is formed by a tab or a cover which extends over the separating device and/or the connecting device in a tightly fitting manner. In particular, this tab or cover prevents an operation of the triggering device or a folding motion of the first and/or third ring in the direction of extension of the strap section. Preferably, the tabs are configured such that they are separably arranged on the carrying system for a rucksack by hook-and-loop fasteners. Thus, the triggering device, for example, may preferably be arranged on the waist strap and may remain connected, in another particularly preferred embodiment, to the connecting devices and/or the carrying system itself after operation. The triggering device mounted on the waist strap may further be covered by means of a tab in such a way that an operation of the triggering device is only possible after the tab has been removed from the triggering device.

In another particularly preferred embodiment, the connecting means connecting the triggering device to the connecting device are arranged along the rucksack and/or the carrying system, and are at least partly connected to it.

In order to be able to provide a chronological order, in particular, for releasing the various connecting devices of the carrying system, the connecting means may in a particularly preferred embodiment be configured such that, particularly due to its length and the section of the securing pin reaching, for example, through the first or second ring and the securing tab, respectively, different triggering points for the connecting devices are provided.

For example, in order to ensure a chronological order of the chest strap, the waist strap and then the shoulder straps, the triggering distance has to be shortest for the securing pin on the chest strap and longest for the shoulder straps. If the arrangement on the triggering device is uniform, operating the triggering device will then first release the connecting device of the chest strap and then those of the waist strap and shoulder straps, respectively.

The object of the present invention is also accomplished by a method for opening a carrying system of a rucksack, which method according to the present invention comprises the following steps.

The carrier, in particular, opens at least one cover or tab of the unlocking device to subsequently operate the unlocking device and the connecting device connected to it. If Bowden cables are used, this is preferably done by pulling out the unlocking device and by the associated removal of the security pin from the connecting systems. Thereby, the connecting systems are opened and the strap sections are separated from the carrier, in particular due to the rucksack's own weight.

In another particularly preferred embodiment of the method for opening a carrying system, opening the connecting systems and separating the strap sections are carried out in a predetermined chronological order, particularly with respect to the shoulder straps, the chest strap and the waist strap.

BRIEF DESCRIPTION OF THE DRAWINGS

The invention will now be described by way of a preferred embodiment, it being noted in particular that the present invention is not thereby limited.

Thus.

DETAILED DESCRIPTION

Figure 1:
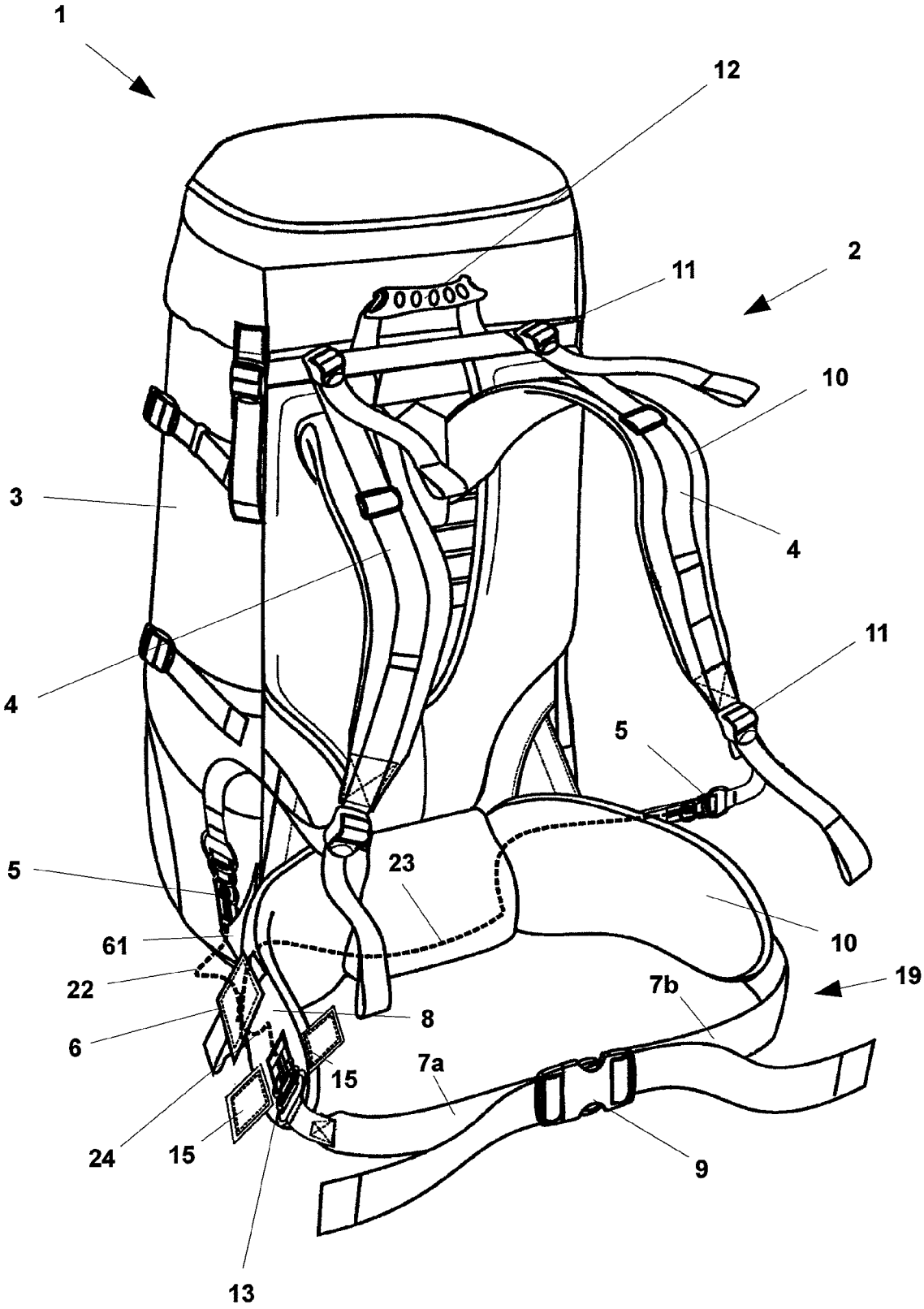
FIG. 1 shows a rucksack with the inventive carrying system.

Thus, FIG. 1 shows an overview of the inventive carrying system 2 for a rucksack 1. In addition to the accommodating container 3, the rucksack comprises a carrying system 2 consisting of two shoulder straps 4 and a waist strap 14. Naturally, the carrying system might also have a chest strap intended to prevent any shifting of the shoulder straps, in particular for heavy loads. On the carrying system 2 there is further arranged a carrying grip 12 which in particular enables carrying the rucksack by hand.

In addition to a padding 10, the shoulder straps 4 comprise multiple strap sections connected to the accommodating container at the upper and lower ends. In order to be able to adjust the lengths of the shoulder strap, multiple adjustment devices 11 are provided by which the length of the shoulder strap or the straps in general can be adapted to the size of the carrier via a tab connection.

In the exemplary embodiment shown, the shoulder straps 4 have at their lower ends connecting devices 5 providing release of the rucksack by operating the triggering device 6 via the connecting means 22, 23 and 24.

The connecting means are arranged at the bottom side of the connecting device 5 and terminate at the triggering device 6, which in FIG. 1 is arranged, in its closed state, in the rear portion of the waist strap.

In addition to the connecting devices 5 of the shoulder straps, the waist strap 14 also includes a second connecting device 13, which in the embodiment shown has opened closing means 15, which in their closed state prevent the connecting device 13 from being inadvertently opened.

The waist strap itself has a rear strap section 8 including, in the embodiment shown, a padding 10. At the front portion, adjoining the connecting device, there are arranged two strap sections 7*a*, 7*b*, which end in a variable-length plug-in fastener 9 on the left and the right. The plug-in fastener 9 serves as a simple opening and connecting device of the strap sections 7*a* and 7*b*, so that the waist strap can be closed and can be adapted to the carrier's body shape in normal use. In particular, the plug-in fastener 9 in the embodiment shown is not operated through the triggering device 6.

Naturally, it is also within the meaning of the present invention that such a plug-in fastener may be omitted and may be replaced by a connecting device as shown at reference numeral 13. Moreover, the connecting device may also be combined with the plug-in fastener.

Figure 2:
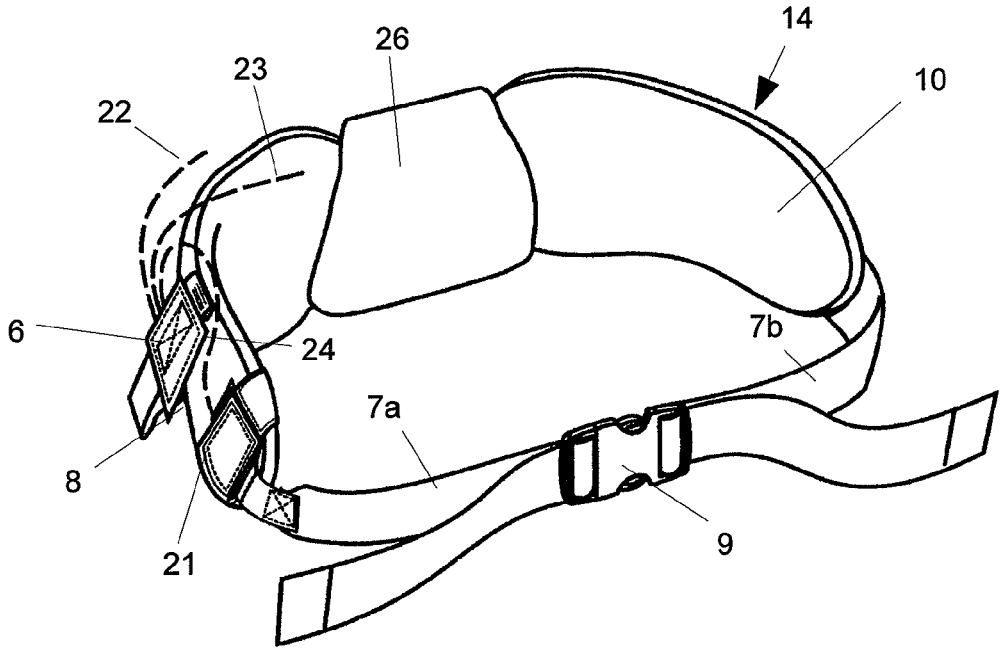
FIG. 2 shows a preferred embodiment of an inventive waist strap with a closed triggering device.

FIG. 2 is a detail illustration of the waist strap of FIG. 1 with the cover 21 of the second connecting device 13 closed. In addition to the strap sections 7*a*/7*b* and 8, the triggering device 6 in its closed state is also shown. Arranged at the rear end of the triggering device there are the connecting devices, such as Bowden cables, which lead to the connecting devices 13, 5. In order to ensure effectiveness, particularly when using Bowden cables, these cables have to be connected to the carrying system particularly at the inlet and outlet portions of the enveloping sheath in order to remove the connecting means from the connecting device upon operation of the triggering device. Furthermore, it is evident from the illustration in FIG. 2 that the waist strap is made of several parts, there being shown, in addition to the paddings 10, also a back padding 24 which can in particular serve to fix the waist strap to the rucksack and the accommodating container, respectively.

Figure 3:
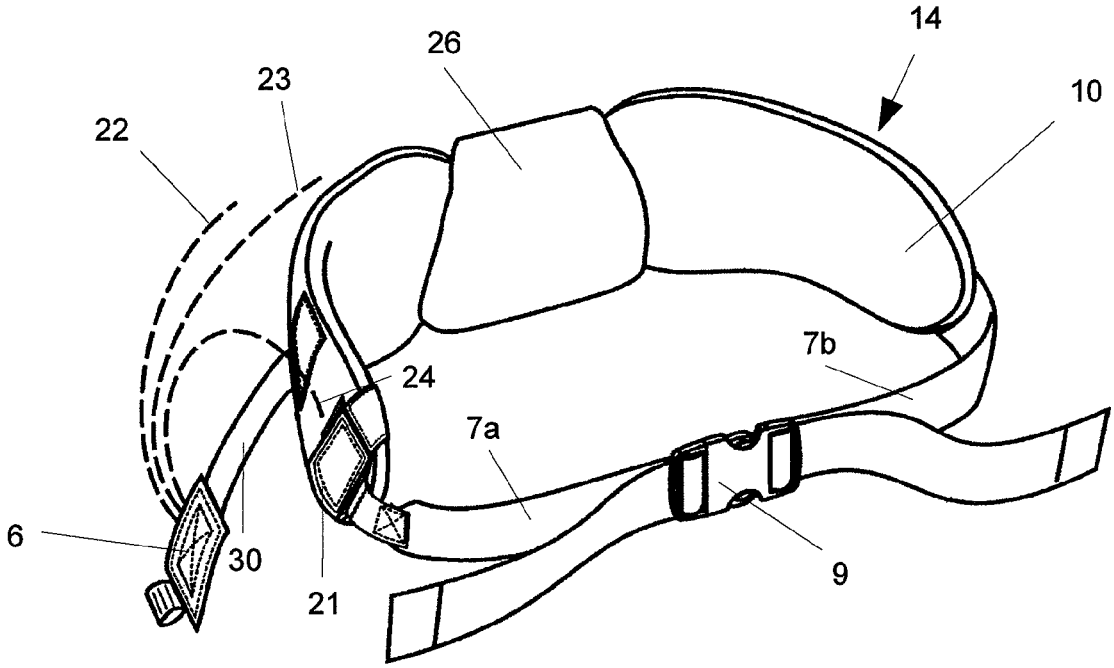
FIG. 3 shows the waist strap of FIG. 2 with an opened triggering device.

In FIG. 3 the waist strap of FIG. 1 is shown after operation of the triggering device 6, it being evident from this illustration in particular that the triggering device 6 is attached to the waist strap 14, for example by a hook-and-loop fastener 25. In the triggered state, the triggering device in the example shown is connected to the waist strap via the connection 30.

Figure 4:
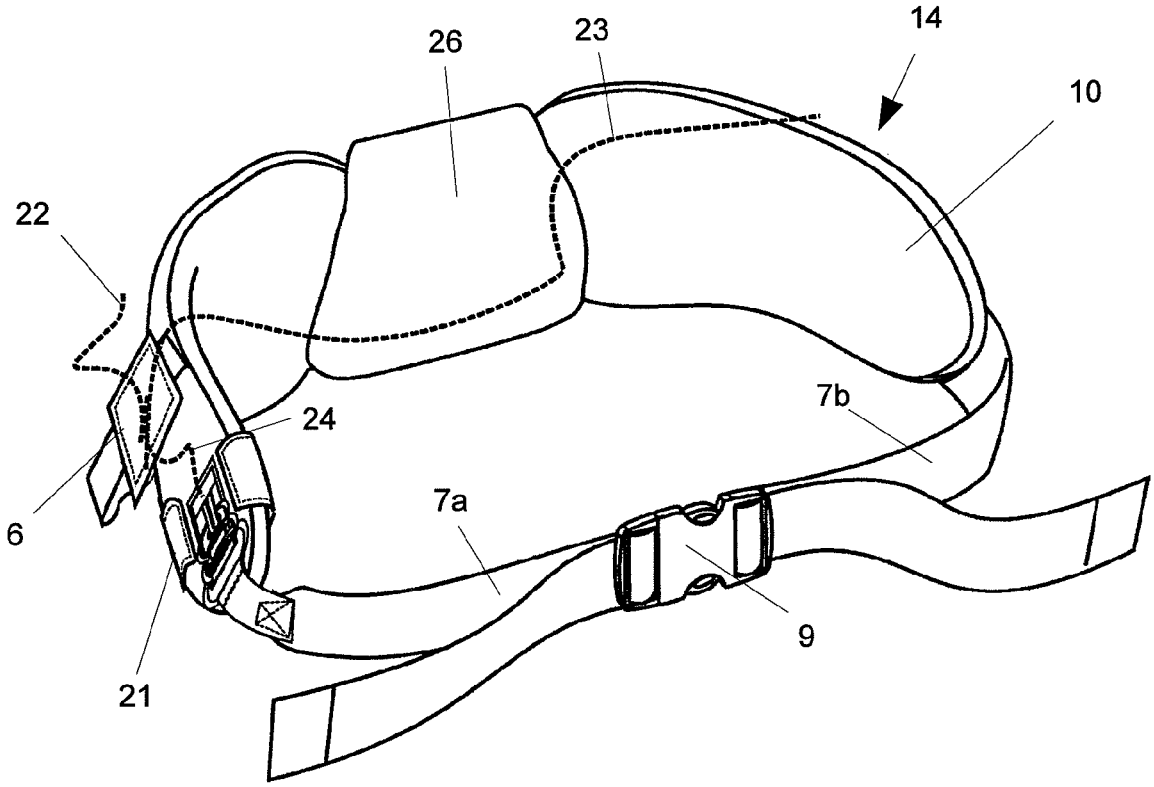
FIG. 4 shows the waist strap of FIG. 2 with an opened locking device of the waist strap.

In FIG. 4, there are shown the waist strap of FIG. 1 in the non-triggered state of the triggering device and the covers 5 of the connecting device 13 in the opened state. It is evident that the connecting device 24 ends in the connecting device 13, with the connecting device 13 itself consisting of three rings having different sizes, and in particular of a tab.

Figures 5, 6:
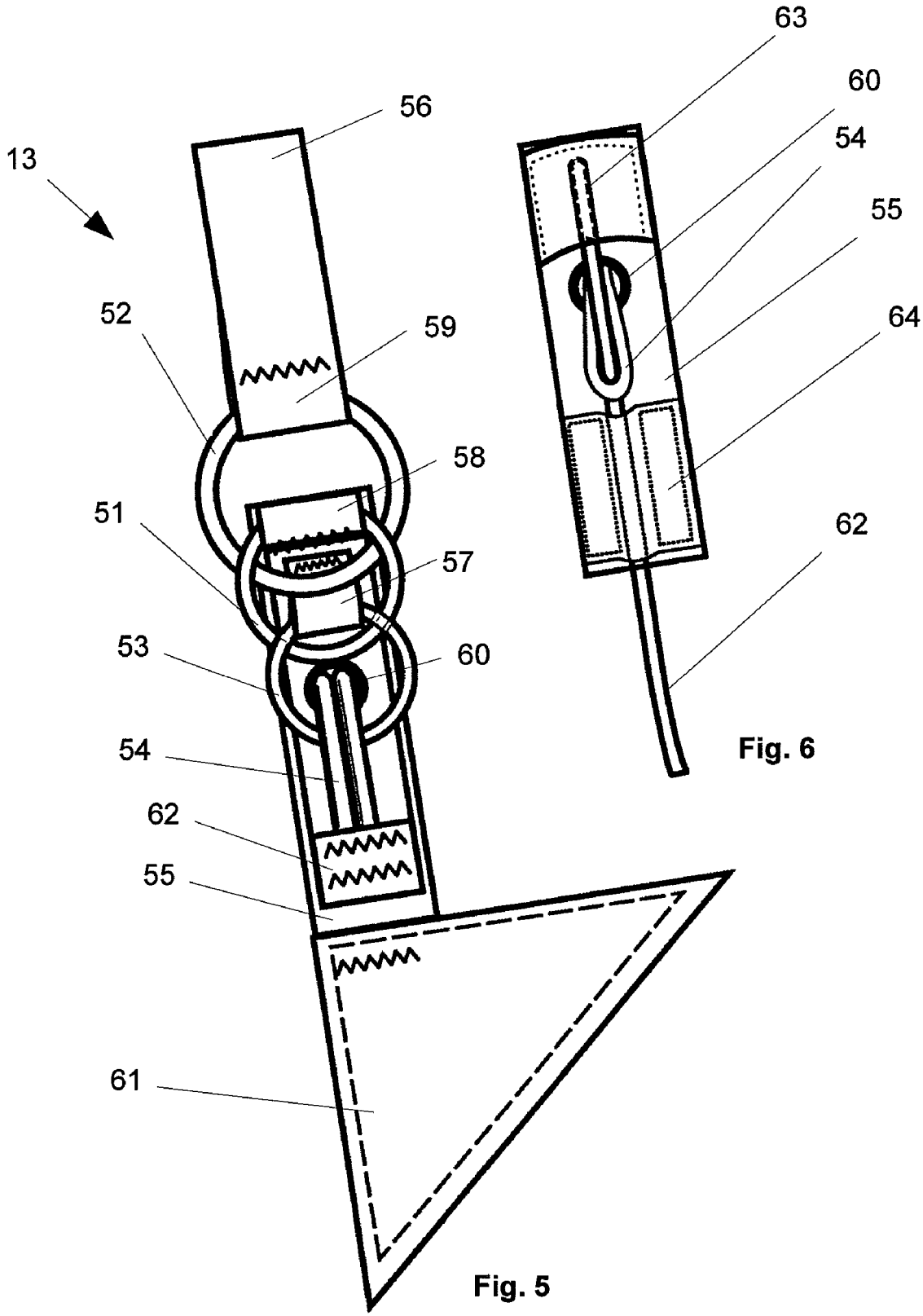
FIG. 5 shows a front view of an embodiment of a connecting device.
FIG. 6 shows a schematic rear view of the connecting device of FIG. 5.

In FIG. 5 there is shown a particular embodiment of the inventive connecting device for a carrying system in detail. In this embodiment, the connecting system comprises three rings 51, 52 and 53, the rings 51 and 53 being connected to the lower section of an upper strap 55 and the ring 52 being connected to the section 56 of a strap. The rings 51 and 53 are connected via the strap section 57 and the mount 58, respectively, and the strap section 55 has in its middle portion an opening 60 through which the tab 54 is passed.

In the closed state of the connecting system, the ring 51 (first ring) reaches through the larger ring 52 (second ring) and is itself kept in the folded position by the ring 53 (third ring). The ring 53 itself is held by the tab 54, which is kept in the closed position on its bottom side by a connecting means 62 and particularly the securing pin 63, as subsequently shown in FIG. 6. In the embodiment shown, the strap section 55 is connected, particularly to the rucksack or the accommodating container, via a connection point 61, and is connected to the rucksack at the top by the strap section 56. In particular, the strap section 56 may be connected to the rucksack directly or, as shown for the shoulder straps in FIG. 1, indirectly by further connecting means. Moreover, the strap section itself may comprise further components such as paddings.

In FIG. 6, the bottom side of the connecting system according to FIG. 5 is shown, there being provided, in addition to the strap section 55, a fastening 64 for the connecting means such as the Bowden cable 62. The securing pin 63, as a component of the connecting means 62, is passed through the tab 54 in such a way that the tab is prevented from being pulled out through the opening 60.

If the Bowden cable is operated by pulling out the triggering device, as shown in FIG. 3, the securing pin 63 is pulled out of the tab 54. The connecting device 13 is opened by the tab 54 subsequently being pulled out of the opening 60 and the ring 53 folding upwards, thus also releasing the ring 51.

Having been released, the ring 51 can in turn fold upwards and release the connection between the strap sections 55 and 56. In this way, the connection between the two strap sections is separated. After releasing all connecting devices of the carrying system, the rucksack is removed from the carrier and falls to the ground, respectively.

The invention claimed is:

1. A carrying system for a rucksack with at least one accommodating container, comprising:

at least two shoulder straps connecting the rucksack to a carrier, wherein each shoulder strap comprises two strap sections and a releasable connecting device connecting the two strap sections to each other;

a triggering device operable by the carrier and connected to each releasable connecting device in such a way that the connecting devices are released causing the strap sections of each shoulder strap to disconnect from one another substantially without time delay upon operating the triggering device; and a securing device including a tab that extend over at least one of the triggering device and the connecting devices, the securing device inhibiting inadvertent operation of at least one of the respective triggering device and the connecting devices in a secured state.

2. The carrying system for a rucksack of claim 1, wherein at least one waist strap is provided comprising at least two strap sections which are connected to each other by a releasable connecting device.

3. The carrying system for a rucksack of claim 2, wherein the triggering device is preferably arranged on the waist strap and remains connected to each of the connecting devices of the shoulder strap and the waste strap even after operation.

4. The carrying system for a rucksack of claim 1, wherein at least one chest strap is provided which connects the at least two shoulder straps to each other and which comprises at least two strap sections connected to each other by a releasable connecting device.

5. The carrying system for a rucksack according to claim 1, wherein the releasable connecting devices are secured, by the securing device, against inadvertent release.

6. The carrying system for a rucksack of claim 1, wherein the connection between the triggering device and the connecting devices is configured by mechanical, electrical and/or optical connecting means which are preferably selected from a group containing electrical conductors, optical conductors, metallic and non-metallic wires, particularly Bowden cables, combinations thereof, and the like.

7. The carrying system for a rucksack of claim 6, wherein the connecting means are arranged along the rucksack and/or the carrying system from the triggering device to the respective connecting devices and at least partly arranged on them.

8. The carrying system for a rucksack of claim 1, wherein the connecting devices include at least a first and second ring, wherein each of the two strap sections of each shoulder strap is fixedly connected to at least one of the rings of the connecting system, and the outer diameter of the first ring is smaller than the inner diameter of the second ring, and wherein in a connected state of the connecting devices the first ring with a part of the strap section attached to it is passed through the second ring and folds back against a direction of extension of the strap section and is secured against a folding motion in the direction of extension of the strap section.

9. The carrying system for a rucksack of claim 8, wherein the connecting devices include at least one third ring, the outer diameter of which is smaller than the inner diameter of the first ring and which is fixedly connected to the same strap section to which the first ring is connected, and wherein in the connected state of the connecting devices the third ring with a part of the strap section attached to it is passed through the first ring and folds back against the direction of extension of the strap section and is secured against a folding motion in the direction of extension of the strap section.

10. The carrying system for a rucksack of claim 9, wherein the first and/or third ring is secured against a folding motion in the direction of extension of the strap section by a retaining device formed by at least one securing tab which is fastened to the strap section and extends, in the connected state of the connecting devices, through the first and/or third ring, and is on the back thereof fixed by a securing pin extending through the securing tab.

11. The carrying system for a rucksack of claim 10, wherein the securing pin is connected to the connecting devices in such a way that it is removed from the securing tab or buckles, preferably pulled out, immediately or by a corresponding actuator upon operation of the triggering device and the securing tab thereby enables a folding motion of the first and/or third ring and a release of the securing tab or the buckles from each other is allowed, respectively.

12. The carrying system for a rucksack of claim 1, wherein at least one of the connecting devices is a buckle coupling, the buckles of which, which are opposed to each other and in a connected state partly engage each other, are connected to each other by means of at least one securing pin going through them.

13. The carrying system for a rucksack of claim 1, wherein the connecting devices are configured in the form of separating means which in the case that the triggering device is operated cause a destructive separation of the two strap sections.

14. The carrying system for a rucksack of claim 1, wherein the tab is configured to be separable by hook-and-loop fasteners.

15. A method for opening a carrying system for a rucksack according to claim 1, including the steps of:

opening the tab from the securing device;

operating the securing device and thereby the connecting devices connected to it; and opening the connecting devices and separating the strap sections from the carrier, in particular due to the own weight of the rucksack.

16. The method for opening a carrying system of claim 15, wherein the opening of the connecting devices and the separation of the strap sections, take place in a predetermined chronological order.

* * * * *